United States Patent [19]

Rashak

[11] Patent Number: 4,843,624

[45] Date of Patent: Jun. 27, 1989

[54] PORTABLE ENCLOSURE SYSTEM FOR AUDIO EQUIPMENT

[75] Inventor: Glen D. Rashak, The Woodlands, Tex.

[73] Assignee: Rashak Enclosures, The Woodlands, Tex.

[21] Appl. No.: 143,459

[22] Filed: Jan. 13, 1988

[51] Int. Cl.[4] ..... H04R 27/00

[52] U.S. Cl. ..... 381/91; 381/88; 381/90; 455/348; 455/351; 181/199

[58] Field of Search ..... 381/88, 87, 90, 91; 358/305; 455/347, 348, 349, 350, 351; 181/199; 84/1.14; 330/1 R

[56] References Cited

U.S. PATENT DOCUMENTS

| | | | |
|---|---|---|---|
| 3,135,838 | 6/1964 | Wright | 381/90 |
| 3,183,305 | 5/1965 | Jesepersen | 381/90 |
| 3,469,031 | 9/1969 | Setchell | 358/305 |

FOREIGN PATENT DOCUMENTS

| | | | |
|---|---|---|---|
| 2932838 | 3/1981 | Fed. Rep. of Germany | 381/87 |
| 321178 | 6/1957 | Switzerland | 381/88 |

*Primary Examiner*—Tommy P. Chin

*Attorney, Agent, or Firm*—Vaden, Eickenroht, Thompson & Boulware

[57] ABSTRACT

An audio equipment enclosure and methods for stacking audio equipment enclosures. One enclosure according to this invention has a compartment for enclosing and supporting an audio amplifier, a compartment for enclosing and supporting one or more audio effects devices, and a compartment for enclosing one or more speakers. A wheeled tray can be releasably secured to the bottom of the enclosure. An extending pedestal member projecting from the bottom of an enclosure can be received in a recess in the top of another enclosure or a recess in a wheeled tray. Front and rear lids or doors on an enclosure can provide access to various items in an enclosure and openings in the enclosures can provide a flow-through air path to enhance air circulation. A fan can be provided in an enclosure to further enhance air circulation and a remotely senseable microphone can be provided near each speaker.

7 Claims, 11 Drawing Sheets

FIG.1A
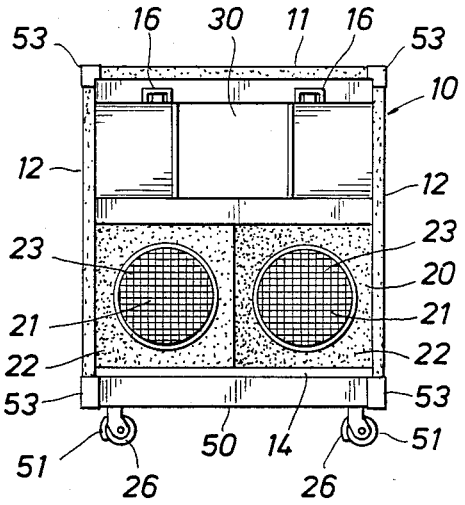
FIG.1B
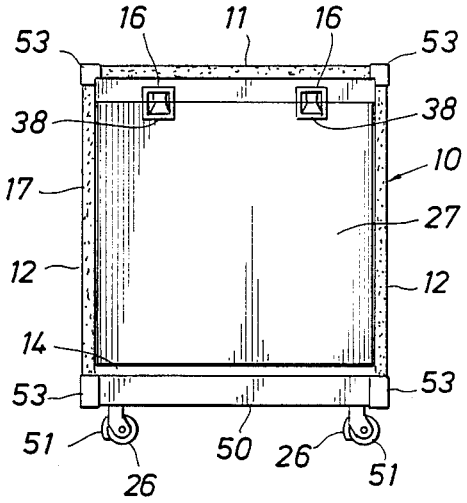
FIG.1C
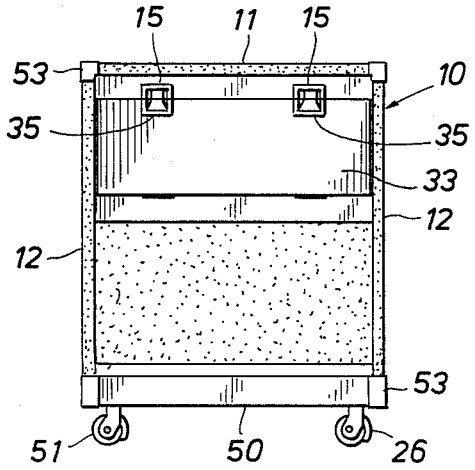
FIG.1D
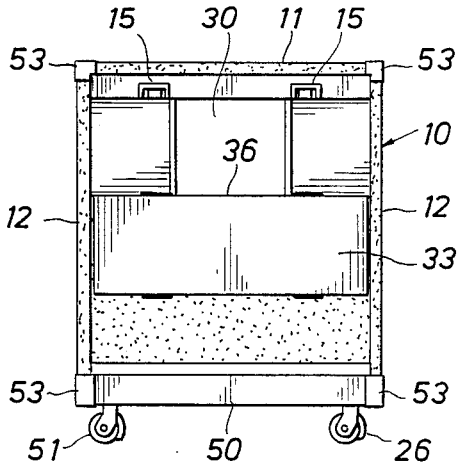
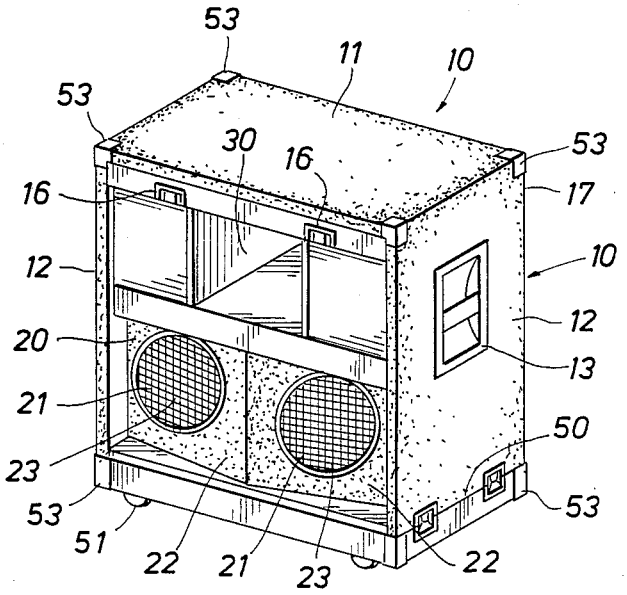
FIG.1E FIG. 1F
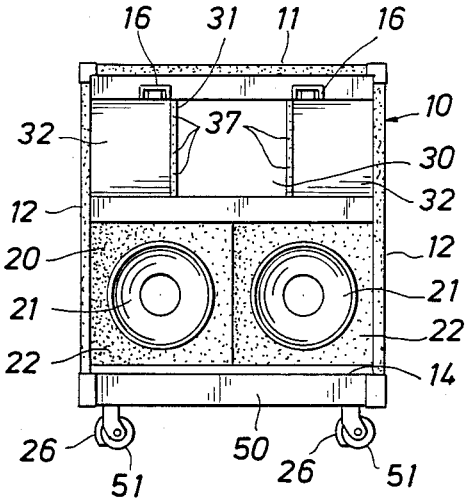
FIG. 1I
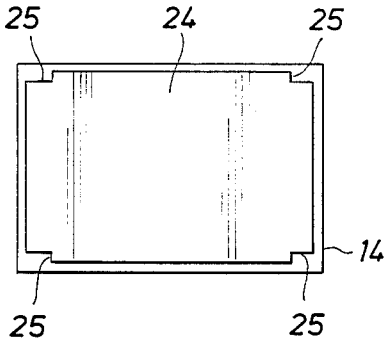
FIG. 1G
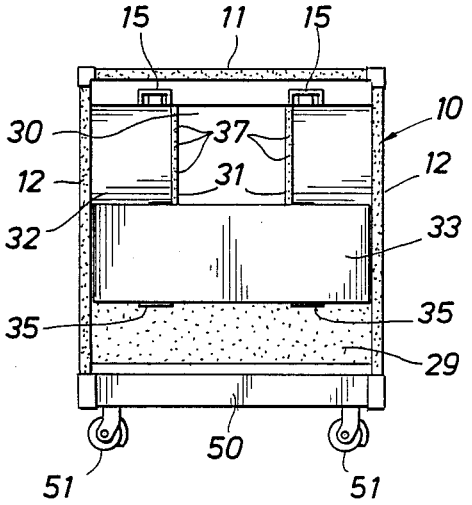
FIG. 1J
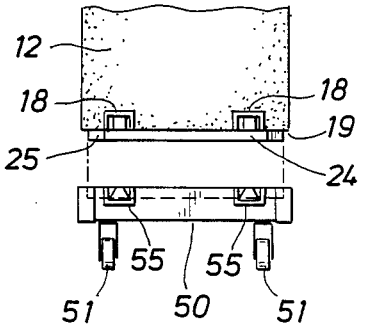
FIG. 1H
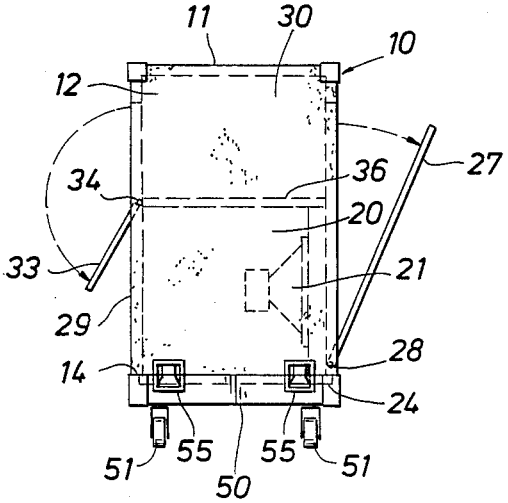
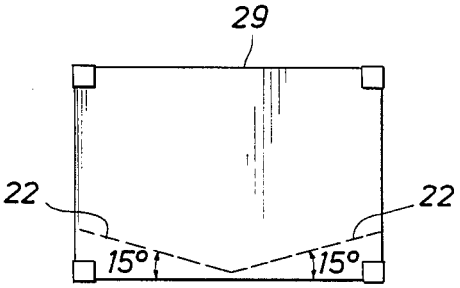
FIG. 1K FIG. 2A
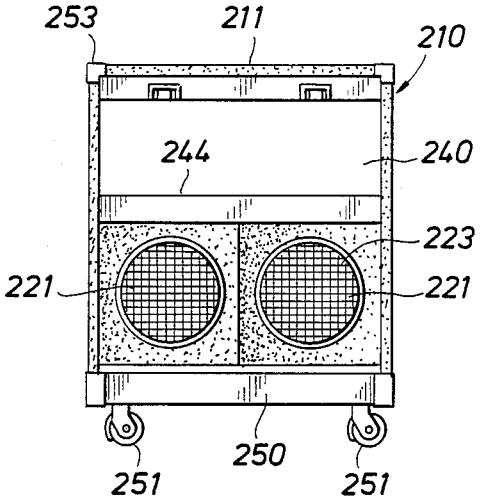
FIG. 2B
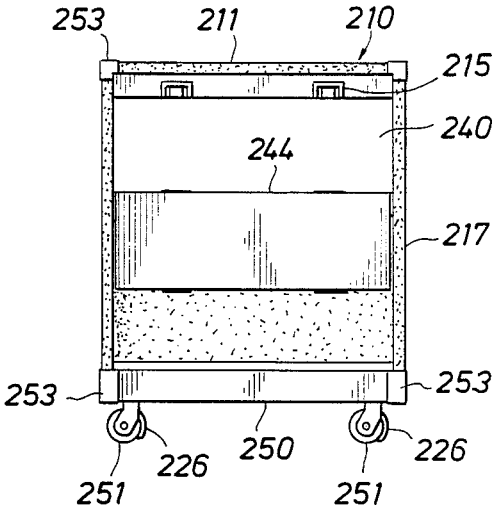
FIG. 2C
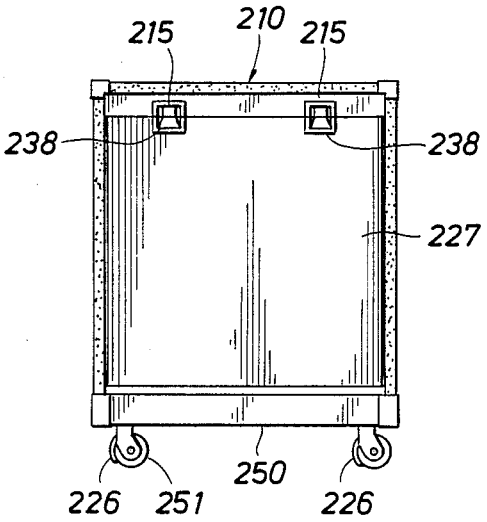
FIG. 2D
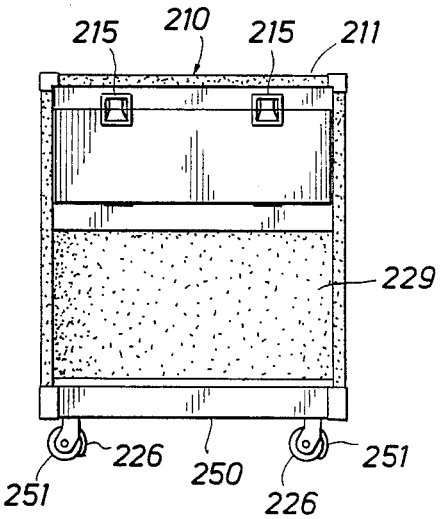
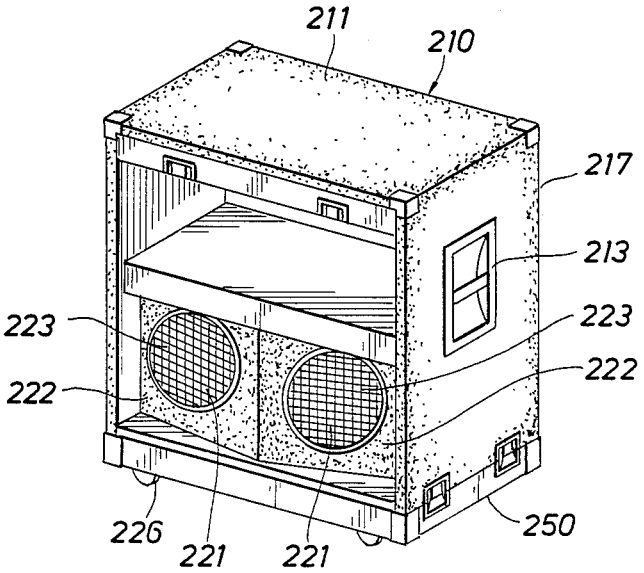
FIG. 2E

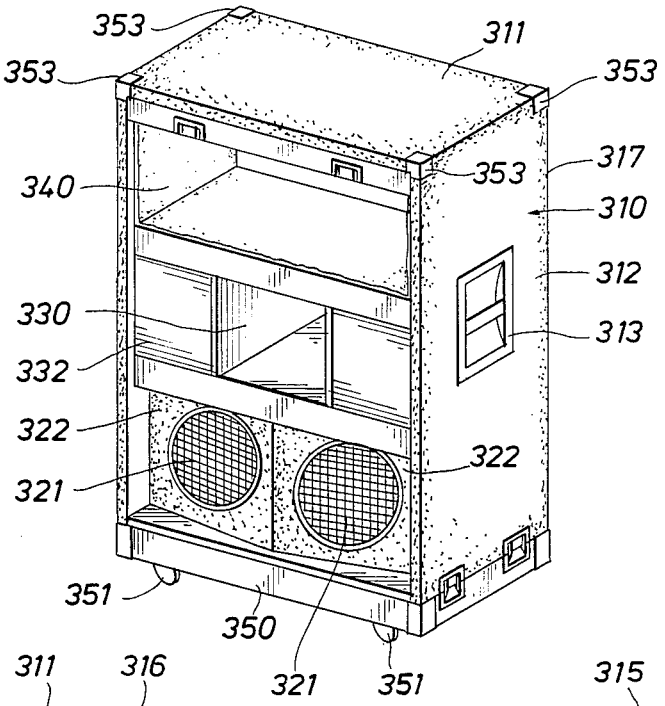
FIG. 3E
FIG. 3G
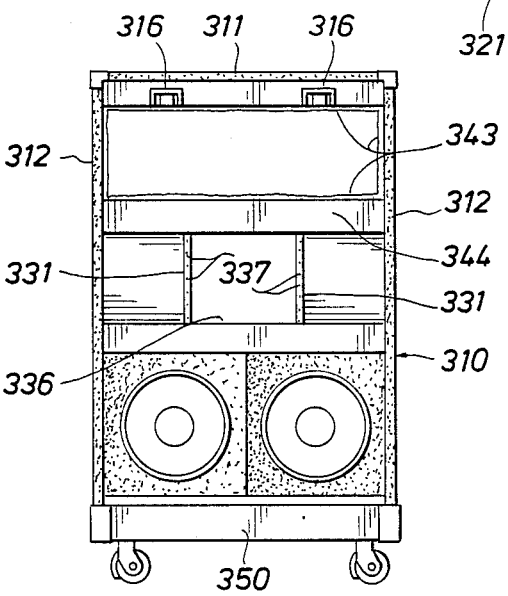
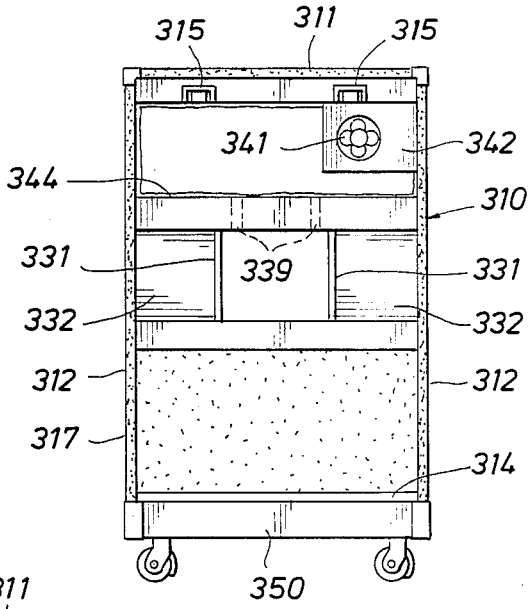
FIG. 3F
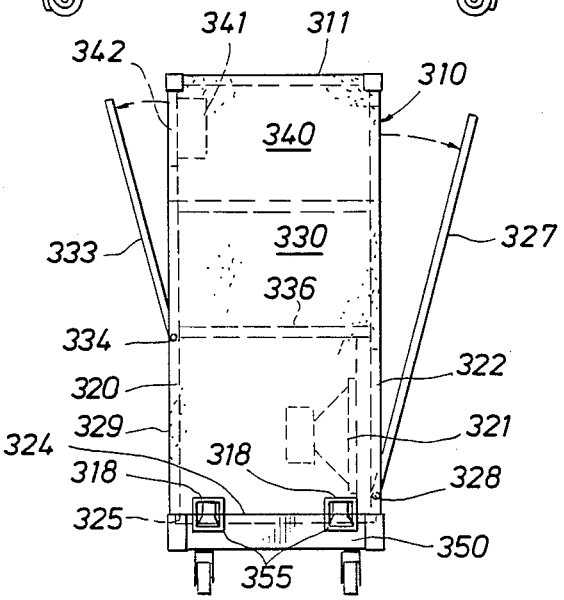
FIG. 3H

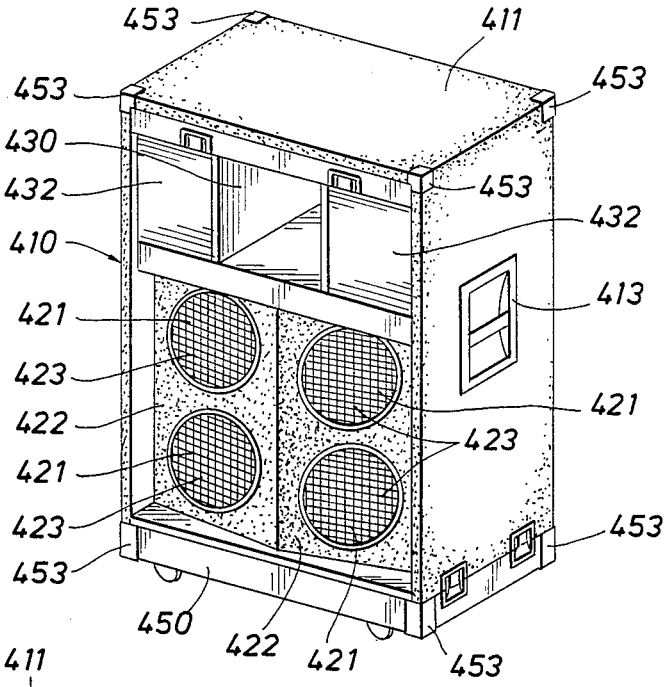
FIG. 4E
FIG. 4G
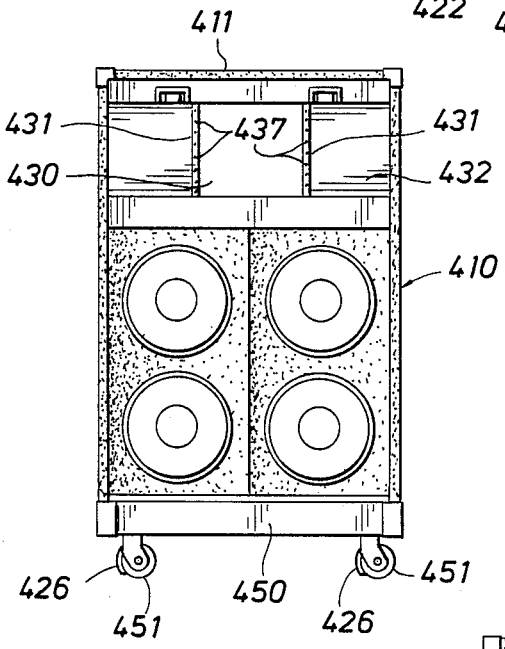
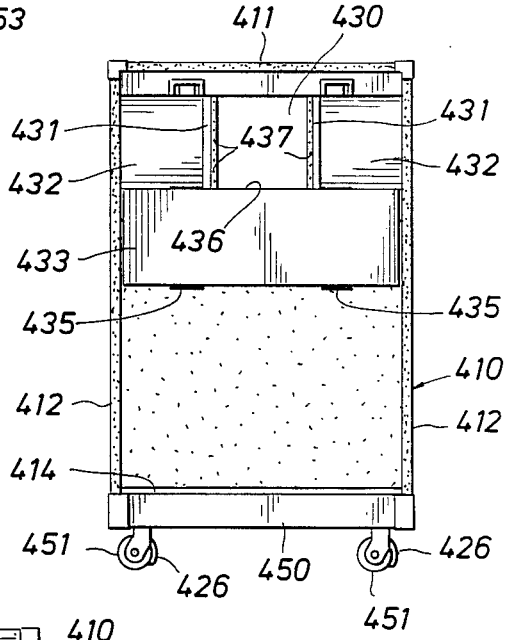
FIG. 4F
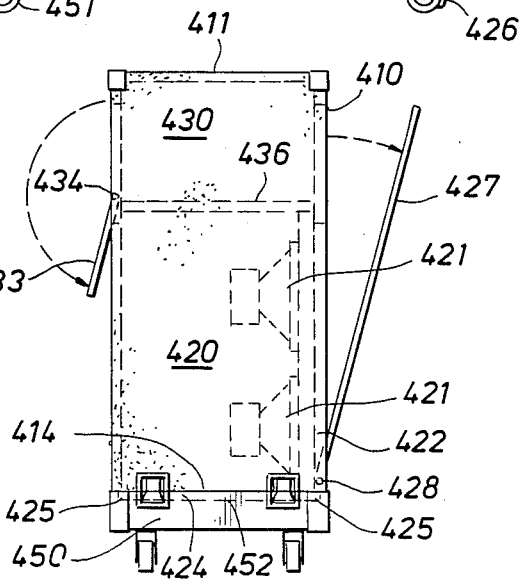
FIG. 4H

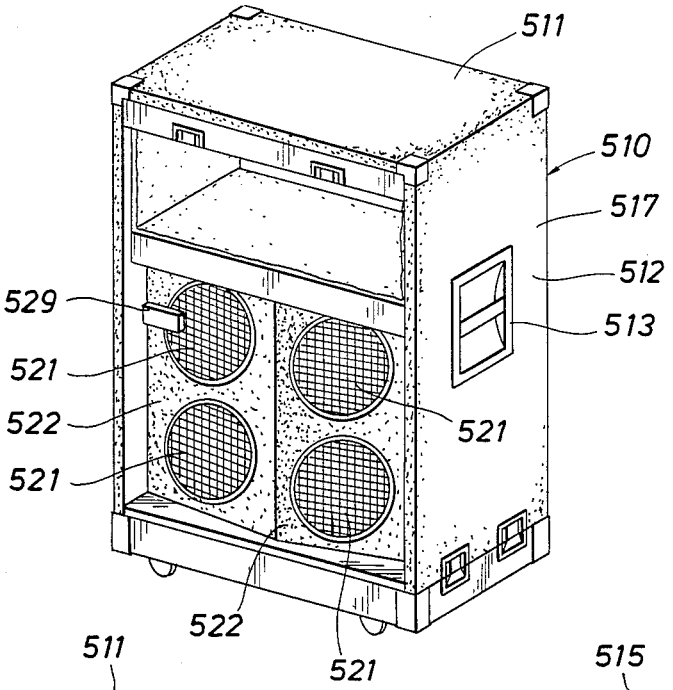
FIG. 5E
FIG. 5G
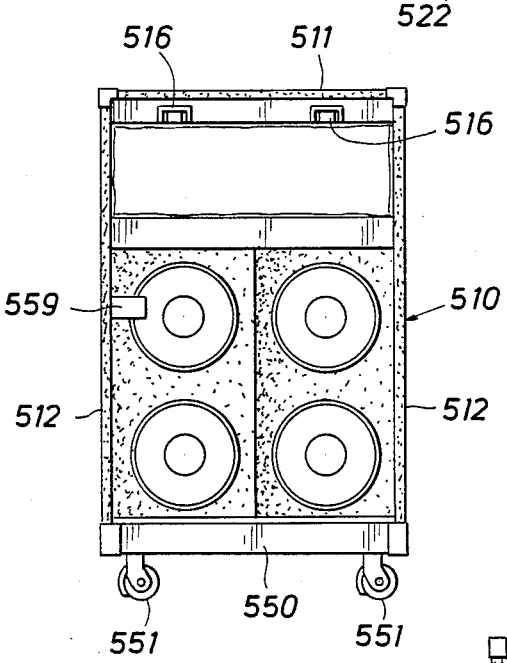
FIG. 5F
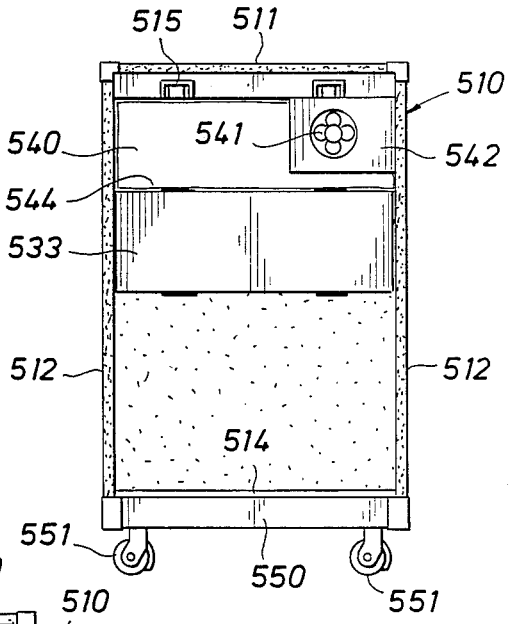
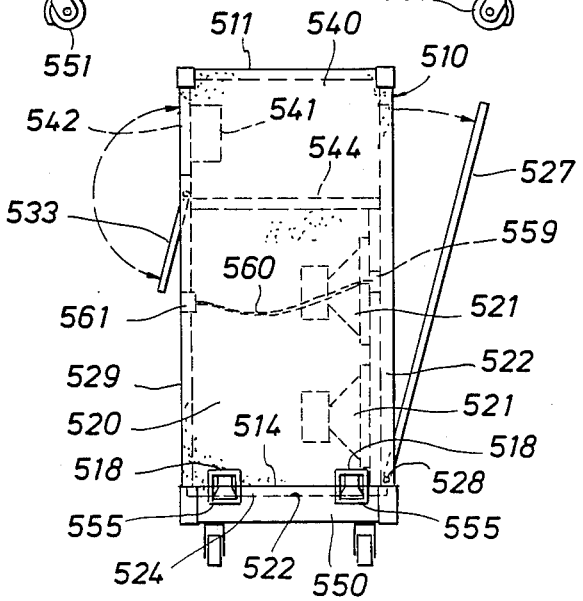
FIG. 5H

PORTABLE ENCLOSURE SYSTEM FOR AUDIO EQUIPMENT

BACKGROUND OF THE INVENTION

1. Field of the Invention

This invention is directed to audio equipment enclosures and methods of their use.

2. Description of Prior Art

Each individual item of prior art audio equipment is usually enclosed in its own case or box. For example a speaker or multiple speakers are contained in one speaker box or housing while audio amplifiers in their own case or box are simply placed on top of the speaker box in an unsecured fashion. The prior art does disclose a single box containing speakers and a piece of audio equipment such as an amplifier permanently mounted in the box and the use of wheels permanently attached to a box. The prior art also discloses the use of a separate wheeled tray or a dolly for moving audio equipment enclosures or speaker boxes by simply putting the box on the dolly or tray. It is known in the art of audio equipment to install a fan within a particular electronic device, such as within the housing of a particular amplifier. It is also known to use recesses in the top of a box into which the wheels of another box are placed.

There are a variety of problems associated with the prior art devices. In stacking the prior art devices resulting stacks are unstable and the height of the stack is limited. Each separate speaker, amplifier, and other audio effects device has to be stacked onto a lower item and the variances in device size, housing strength, and housing configuration severely limit stacking possibilities. To transport prior art devices, containers are required which are strong, movable, and which protect the equipment from jarring and rough handling. Often multiple shipping containers are required. Although an individual electronic device may have a built-in-fan, this fan may not be designed to contend with the increased heat exchange demands encountered when an additional piece of equipment is stacked on top of the electronic device. Also, in prior art enclosures which completely surround a device (but for an open front access panel) air circulation is inhibited.

There has long been a need for an efficient and effective audio equipment enclosure. There has long been a need for an audio equipment enclosure which can efficiently and effectively support and enclose a variety of different kinds of audio equipment. There has long been a need for an effective and efficient audio equipment enclosure with air circulation apparatus and with openings for enhancing air flow. There has long been a need for an audio equipment enclosure which can serve as an acceptable container for shipment. There has long been a need for audio equipment enclosures which can be securely stacked upon each other.

The present invention recognizes, addresses, and satisfies these long-felt needs as well as others.

In accordance with §1.56 of 37 C.F.R. the following prior art references are disclosed and copies of them are submitted herewith:

1. Mesa/Boogie (Reg. T.M.), WAM June 1987, page 34 discloses a speaker box with a separate audio device on top of the speaker box and a speaker box with an audio device permanently mounted within the same box.
2. Illinois Entertainer June 1987, Peavey (Reg. T.M.), page 77, discloses a speaker box with an audio device permanently mounted within the same box; Jamo, page 78, speaker boxes with multiple speakers and attached wheels.
3. Carlsbro, Guitar Player January 1987, page 151 discloses speaker boxes with audio devices permanently mounted in the same box.
4. Kustom, Guitar Player January 1987, page 154, discloses a wheeled speaker box and an individual, separate amp stacked on top of the speaker box.
5. Marshall, Guitar Player January 1987, page 148, discloses a stack of a variety of separate items including two separate four-speaker boxes and a separate audio device. One of the speaker boxes has wheels.
6. Invisible (Reg. T.M.), Guitar Player 1987, page 64, discloses an "Amp and Rack stand" which supports a rack containing a variety of audio effects devices and a speaker box which includes a built-in audio device.
7. Mesa/Boogie, Guitar Player 1987, page 119 discloses a variety of individual speakers, speaker boxes with built-in audio devices, and wheeled boxes.
8. Rane, Music and Sound Retailer June 1987, page 18, discloses a variety of audio devices for mounting into a rack.
9. Rickenbacker (Reg. T.M.), Music and Sound Retailer June 1987, page 39, discloses a box containing a multi-functional amplifier permanently built-in and a speaker or speakers.
10. Dean Markley, Music and Sound Retailer June 1987, page 39, discloses a bass guitar amplifier and a speaker enclosed in a single cabinet.
11. Guitar Buyer's 1987–88, Nady Systems, page 80, discloses a single box with a speaker and a permanently installed wireless receiver amplifier; Moridira, same page, discloses a box with speaker and permanently installed audio effect device and legs extending from box.
12. Mesa/Boogie, Guitar Buyer's Guide 1987–88, page 80, discloses a speaker box with two speakers, one of which is tilted from the vertical.
13. Marshall, Guitar Buyer's Guide 1987–88, page 77, discloses two wheeled boxes one stacked on top of the other with the wheels of the top box resting in recesses in the top of the bottom box.
14. Guitar World June 87, page 78, discloses an enclosure including a plurality of audio effect devices and having wheels attached to its bottom; also an enclosure having three Marshall amplifiers.

"Head" usually refers to an amplifier and "rack devices" usually refers to one or more audio effects devices such, for example, as a reverberation unit, a phaser, a filter, and a graphic equalizer which are emplaced in a rack and are usually permanently or semi-permanently affixed to the rack. Applicant is filing an application for design patent directed to his audio equipment enclosure design.

SUMMARY OF THE INVENTION

The present invention teaches a novel, unobvious, and efficient audio equipment enclosure and methods for stacking two or more such enclosures. An enclosure according to this invention has a body which includes compartments which can house, enclose, and support one or more pieces of audio equipment such as amplifiers ("heads"), audio effects devices ("rack devices"), or speakers. A shelf can be provided to support items above the bottom of the enclosure. In one embodiment a releasable wheeled tray is securely connected to the body of the enclosure to make movement of the enclosure easier. In one embodiment the tray may have an opening in it for receiving a member projecting from an enclosure. By appropriately sizing and configuring the recess and the projecting member the enclosure may be firmly positioned and releasably secured above, on, and partially in the tray in a very stable manner. For enhanced air circulation openings through the enclosure can be provided and a fan can be positioned to blow or suck air through the openings. Movable doors or lids can be provided for completely closing off the front and rear of the enclosure with (or without) the audio equipment still inside so that the enclosure is itself a suitable shipment container. In one embodiment an enclosure can have a recess in its top for receiving and holding a member projecting from another enclosure to facilitate correct stacking of the enclosures and to produce a stable stack. The compartments in the enclosure can be foam lined.

To one of skill in this art who has the benefit of the teachings of this invention, other and further features, objects, and advantages will be clear from the following description of presently-preferred embodiments, given for the purpose of disclosure, when taken in conjunction with the accompanying drawings.

DESCRIPTION OF THE DRAWINGS

FIG. 1A is a front view of an audio equipment enclosure according to the present invention;

FIG. 1B is a front view of the enclosure of FIG. 1A with a front lid in place;

FIG. 1C is a rear view of the enclosure of FIG. 1A with a rear door closed;

FIG. 1D is a view of the enclosure as shown in FIG. 1C with the rear door open; and FIG. 1E is a side perspective view of the enclosure of FIG. 1A.

FIG. 1F is a front view of the enclosure of FIG. 1A similar to FIG. 1A, but with no speaker grilles;

FIG. 1G is a rear view of the enclosure with the rear door open;

FIG. 1H is a side view partially cut away of the enclosure of FIG. 1F and showing a a front lid and rear door;

FIG. II is a bottom view of the enclosure of FIG. 1A;

FIG. 1J is a partial side view of an enclosure such as that of FIG. 1A with the upper body of the enclosure separated from the wheeled tray and showing the pedestal extending from the enclosure;

FIG. 1K is a partial view of the enclosure of FIG. 1A showing the inclination of the speaker baffles.

FIG. 2A is a front view of an audio equipment enclosure according to the present invention;

FIG. 2B is a rear view of the enclosure of FIG. 2A with a rear door open;

FIG. 2C is a front view of the enclosure of FIG. 2A with a front lid closed;

FIG. 2D is a rear view of the enclosure as in FIG. 2B with the rear door closed; and FIG. 2E is a side perspective view of the enclosure of FIG. 2A.

Figure 2F:
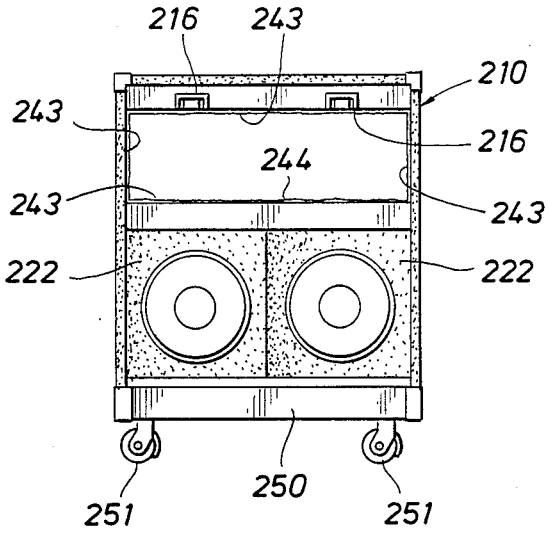
Figure 2G:
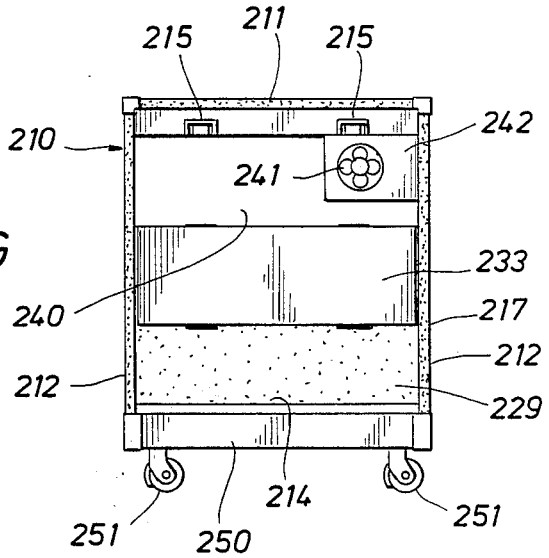
Figure 2H:
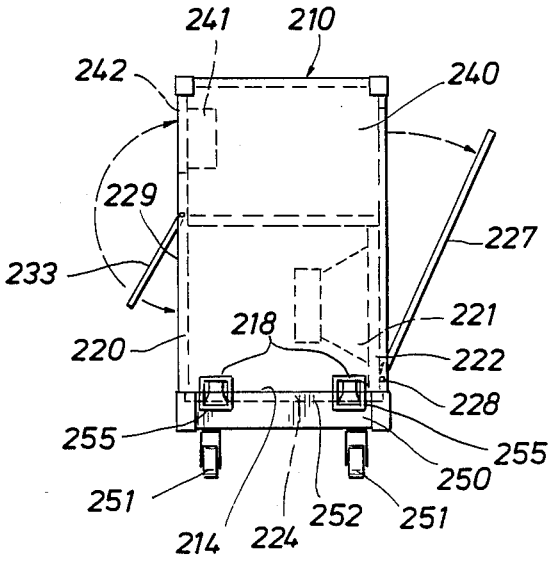

FIG. 2F is a front view of the enclosure of FIG. 1A and similar to FIG. 1A, but with no speaker grilles;

FIG. 2G is a rear view of the enclosure of FIG. 2F and showing a fan;

FIG. 2H is a side view partially cut away of the enclosure of FIG. 2G and showing a rear door and a front lid.

Figure 3A:
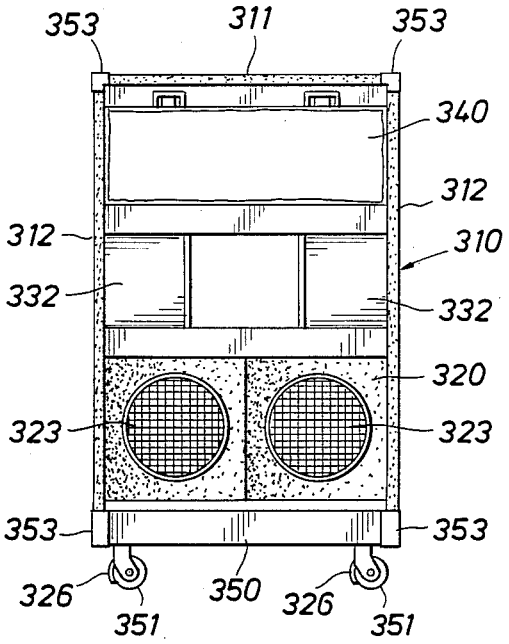
Figure 3B:
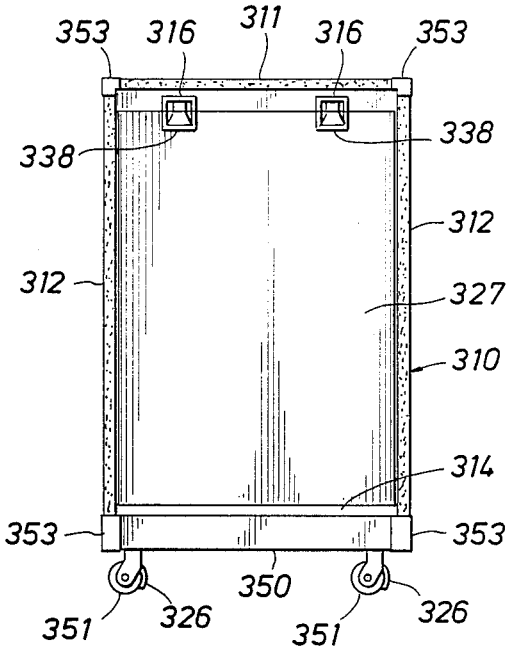
Figure 3C:
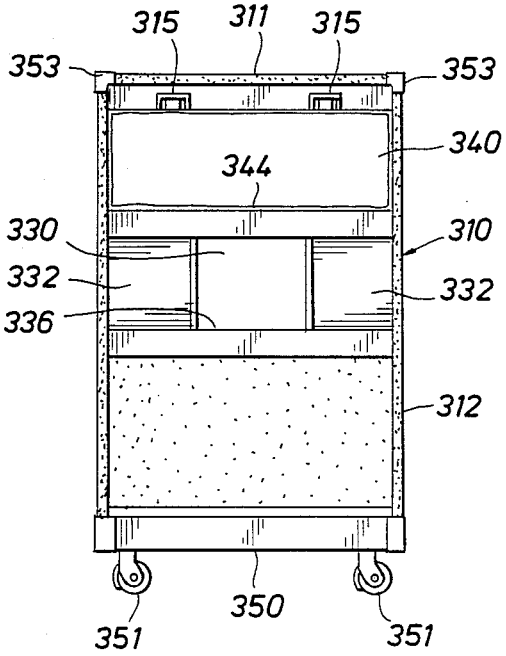
Figure 3D:
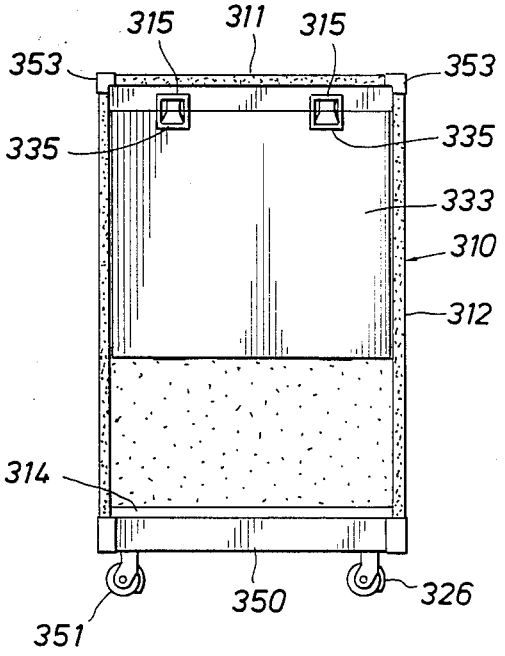

FIG. 3A is a front view of an audio equipment enclosure according to the present invention;

FIG. 3B is a front view of the enclosure of FIG. 3A with a front lid in place;

FIG. 3C is a rear view of the enclosure of FIG. 3A;

FIG. 3D is a rear view of the enclosure of FIG. 3A with a rear lid in place;

FIG. 3E is a side perspective view of the enclosure of FIG. 3A.

FIG. 3F is a front view of the enclosure of FIG. 3A and similar to FIG. 3A, but with no speaker griles;

FIG. 3G is a rear view of the enclosure of FIG. 3F and showing an electric fan;

FIG. 3H is a side view partially cut away of the enclosure of FIG. 3G and showing a rear lid and a front lid.

Figure 4A:
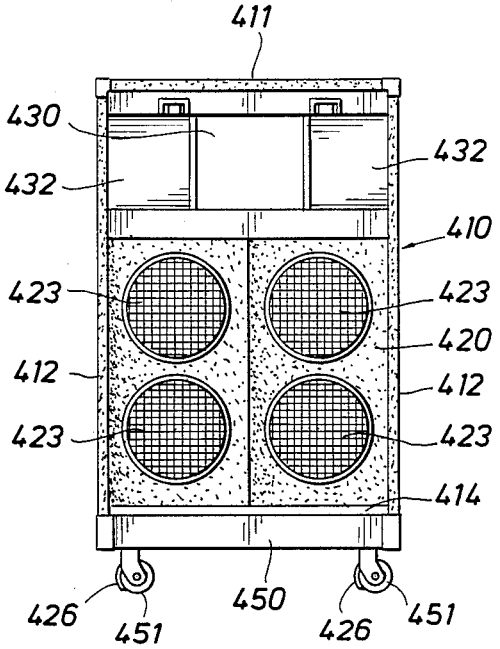
Figure 4B:
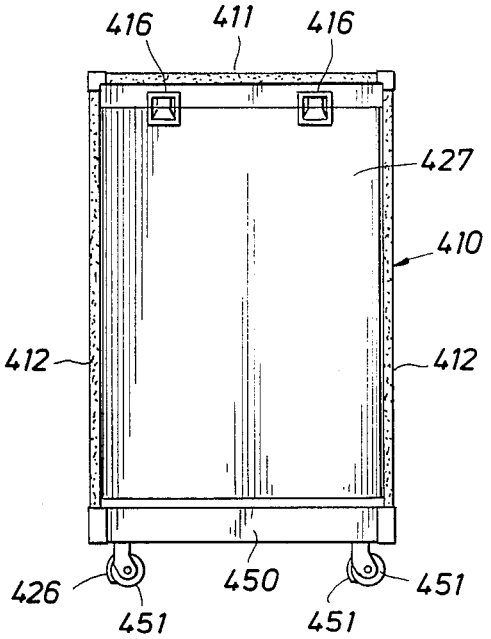
Figure 4C:
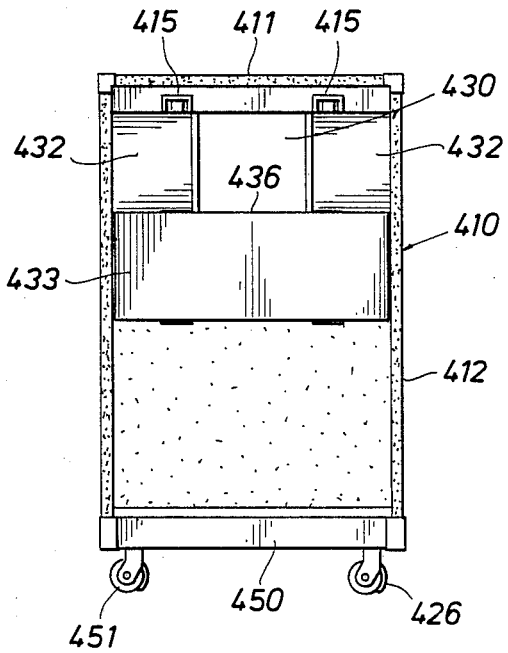
Figure 4D:
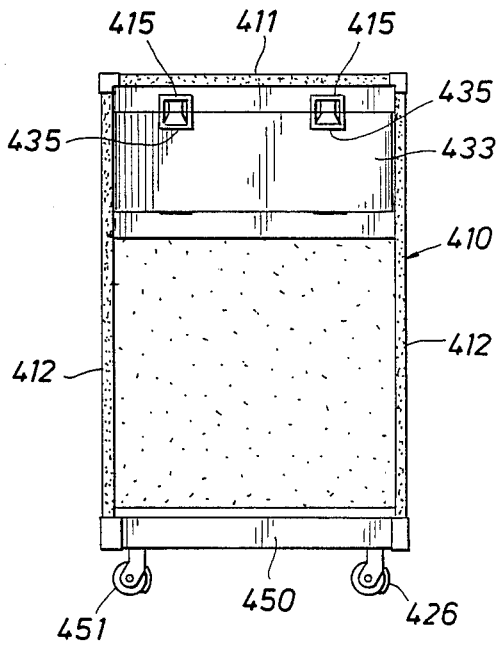

FIG. 4A is a front view of an audio equipment enclosure according to the present invention;

FIG. 4B is a front view of the enclosure of FIG. 4A with a front lid in place;

FIG. 4C is a rear view of the enclosure of FIG. 4A with a rear door open;

FIG. 4D is a rear view of the enclosure of FIG. 4A with the rear door in place and closed;

FIG. 4E is a side perspective view of the enclosure of FIG. 4A.

FIG. 4F is a front view of the enclosure of FIG. 4A and similar to FIG. 4A but with no speaker griles;

FIG. 4G is a rear view of the enclosure of FIG. 4F; and

FIG. 4H is a side view partially cut away of the enclosure of FIG. 4A and showing a rear door and a front lid.

Figure 5A:
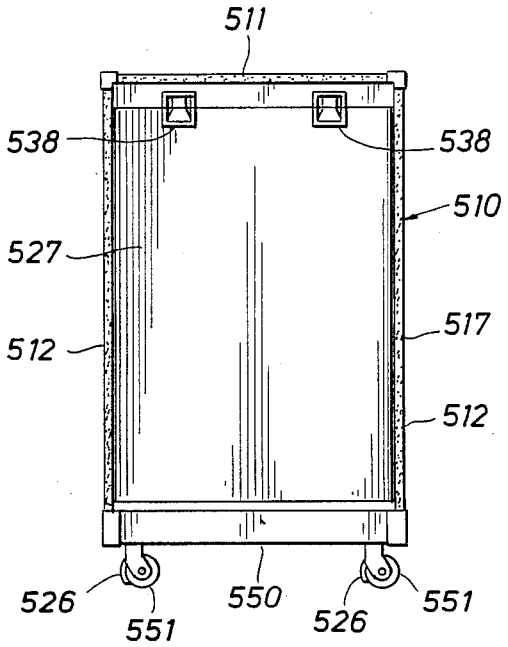
Figure 5B:
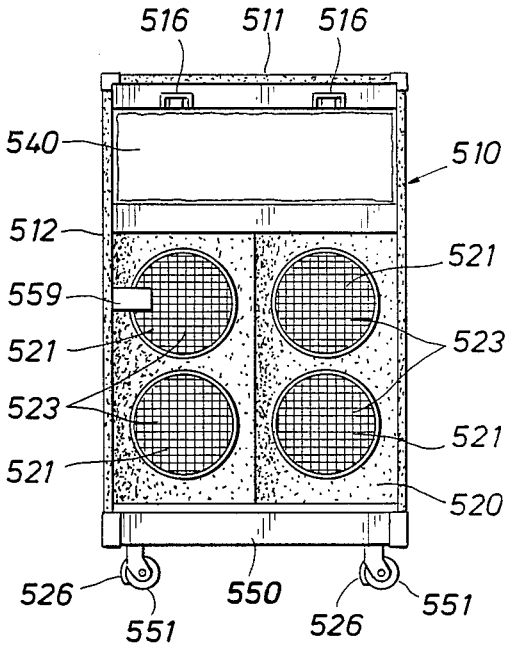
Figure 5C:
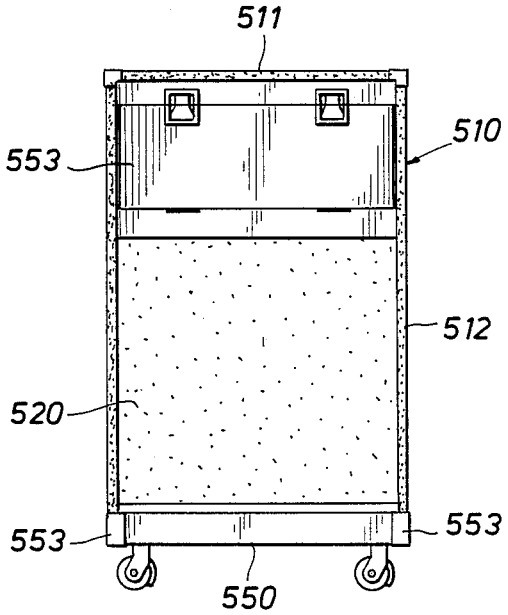
Figure 5D:
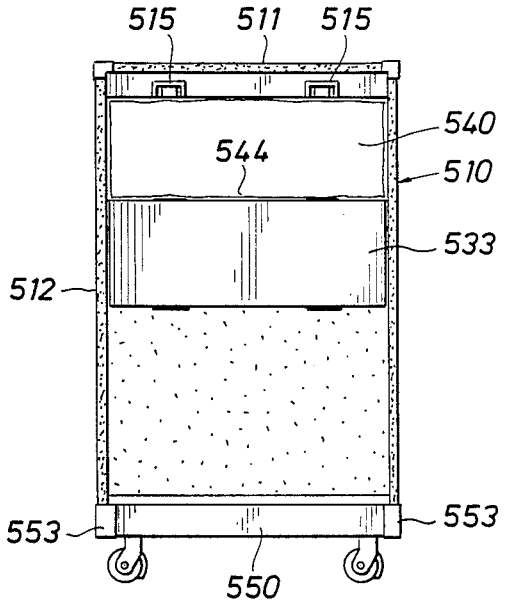

FIG. 5A is a front view of an audio equipment enclosure according to the present invention with a front lid in place;

FIG. 5B is a front view of the enclosure of FIG. 5A with the front lid removed;

FIG. 5C is a rear view of the enclosure of FIG. 5A with a rear door in place;

FIG. 5D is a rear view of the enclosure as shown in FIG. 5C with the rear door open;

FIG. 5E is a side perspective view of the enclosure of FIG. 5A.

FIG. 5F is a front view of the enclosure of FIG. 5A and similar to FIG. 5A but with no speaker grilles;

FIG. 5G is a rear view of the enclosure of FIG. 5F and showing an electric fan;

FIG. 5H is a side view partially cut away of the enclosure 5G and showing a rear door and a front lid.

Figure 6A:
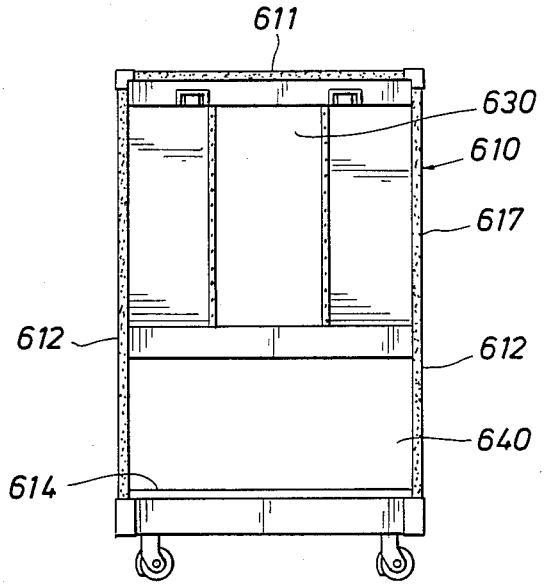
Figure 6B:
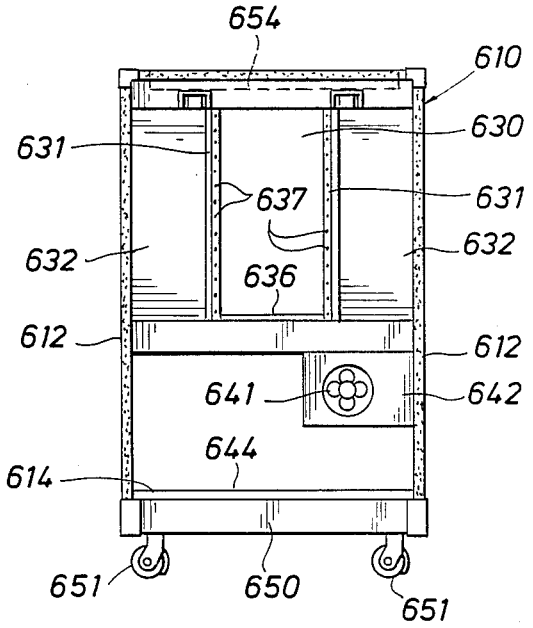
Figure 6C:
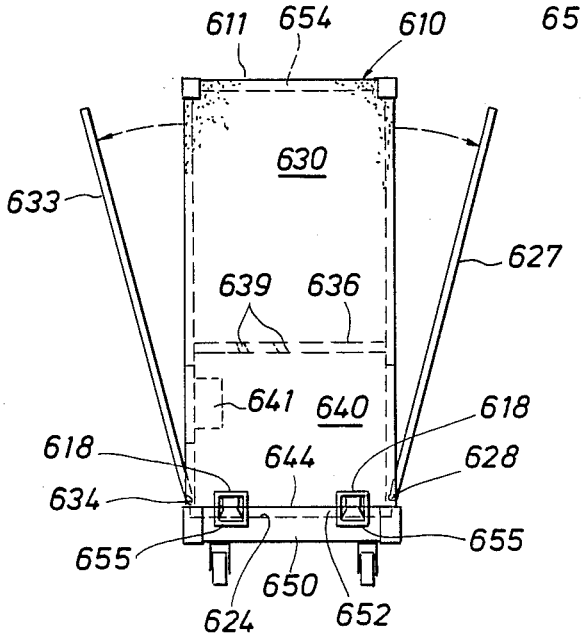

FIG. 6A is a front view of an enclosure according to the present invention;

FIG. 6B is a rear view of the enclosure of FIG. 6A;

FIG. 6C is a side view of the enclosure of FIG. 6A and showing front and rear removeable lids.

DESCRIPTION OF PREFERRED EMBODIMENTS

In the drawings of the embodiments various numbers correspond to the same or similar features. For example, the numbers 51, 251, 351, 451, 551, and 651 refer to wheels or casters in the embodiments in the figures in which they appear. In other words, for the items listed below the same two ending digits (e.g. "51") indicate the same or a similar feature of the embodiments:

| | |
|---|---|
| audio equipment enclosure | 10 |
| top wall | 11 |
| side walls | 12 |
| side handles | 13 |
| bottom wall | 14 |
| rear door lock receiver | 15 |
| front door lock receiver | 16 |
| body | 17 |
| tray lock receiver | 18 |
| bottom surface of body | 19 |
| speaker chamber | 20 |
| speakers | 21 |
| baffle | 22 |
| grille | 23 |
| pedestal or projecting, extending member | 24 |
| notches | 25 |
| wheel, caster locks | 26 |
| front lid or door | 27 |
| front lid hinge | 28 |
| speaker chamber back wall | 29 |
| rack compartment | 30 |
| vertical members | 31 |
| storage areas | 32 |
| rear door or lid | 33 |
| rear door hinge | 34 |
| rear door locks | 35 |
| rack shelf | 36 |
| rack holes | 37 |
| front door locks | 38 |
| rack shelf holes | 39 |
| head compartment | 40 |
| fan | 41 |
| fan mount | 42 |
| foam liner | 43 |
| head shelf | 44 |
| tray | 50 |
| casters or wheels | 51 |
| pedestal recess | 52 |
| plastic corners | 53 |
| top recess | 54 |
| tray lock | 55 |
| upper surface of tray | 56 |
| access flap | 57 |
| access flap hinge | 58 |

Referring now to the embodiment of FIGS. 1A–1K, the audio equipment enclosure 10 has an integral body 17 formed by a top wall 11, side walls 12, bottom wall 14, a speaker chamber back wall 29, and a rack shelf 36. Side handles 13 are secured to and in the side walls 12 (one side handle is shown in FIG. IE). The body 17 has a rack compartment 30 above and a speaker chamber 20 below.

A wheeled tray 50 is releasably secured to the bottom of the body 17 by an extending pedestal member in a tray recess described in detail below and/or by means of tray locks 55 which are received in and coact with tray lock receivers 18 secured to the bottom of the body 17. A pedestal or projecting member 24 is secured to or formed integrally with the bottom wall 14 of the body 17. It is preferred that the pedestal 24 have some irregularity such as (but not limited to) a concave portion, a convex portion, a tongue portion, a dovetail portion, or notches as the notches 25 to assist in accurate positioning of the pedestal 24 in a recess 52 in the tray 50. The recess 52 of the tray 50 is configured appropriately to receive and hold the pedestal 24. In a typical operation, the enclosure 10 is positioned above the tray 50 and the enclosure 10 is then lowered so that the pedestal 24 enters into the recess 52. The enclosure 10 is then lowered so that the bottom surface 19 of the body 17 contacts and rests on the upper surface 56 of the tray 50. Thus the enclosure 10 is properly positioned on the tray 50 and is stabilized and secured in place. As the body 17 is lowered into place on the tray 50, the tray locks 55 are received in the tray lock receivers 18 of the body 17. Engaging the locks provides further stability and securement to the body-tray connection. The tray 50 has four rotatable wheels or casters 51 which can be prevented from moving by engaging wheel or caster locks 26 which are associated with each wheel.

The speaker chamber 20 has a back wall 29. Two speakers 21 are mounted to baffles 22 which extend across the front of the speaker chamber 20. Grilles 23 protect the front of the speakers 21. It is preferred that the baffles be positioned to form a "V" with respect to the front plane of the enclosure 10 with the arms of the "V" extending backwardly from the front toward the back wall 29. The most preferred angle is an angle of 15° as shown in FIG. 1K.

The rack compartment 30 has vertical members 31 which extend from a rack shelf 36 upwardly to the top wall 11. A storage area 32 is formed between each vertical member 31 and its respective adjacent side wall 12. A series of holes 37 are provided in each vertical wall 31 so that audio effects devices can, if desired, be secured to the vertical members 31. Of course the audio effects devices can simply be stacked on top of each other in the rack compartment 30. Both the back and the front of the rack compartment 30 are open so that air can flow through the rack compartment.

To close off the enclosure 10 a front lid 27 and a rear door 33 are provided. The rear door 33 is hingedly connected to the back wall 29 with a hinge 34. Rear door locks 35 are secured to the rear door 33 and are positioned so that they are receivable in rear door lock receivers 15 secured to an access flap 57 hingedly and movably connected to the body 17 with the access hinge 58. The rear door 33 can be moved to close off the rear of the rack compartment 30. Engaging the rear door locks with the rear door lock receivers secures the door 33 shut. Similarly the front lid 27 is hingedly connected to the front of the body 17 and can be moved to close off and protect the speakers 21 and the front of the rack compartment 30. Front door locks 38 are secured to the front door 27 and are positioned so that they are receivable in front door lock receivers 16 secured to the top of the body 17 when the front door 27 is moved to close off the front of the enclosure 10. Releasable hinges may be used so that either the front lid or the rear door may be removed from the enclosure.

With the front door 27 and the rear door 33 closed the enclosure 10 can be safely shipped or moved. Audio equipment left in the enclosure 10 is adequately protected and no separate shipping container for the enclosure is needed. Plastic corners 53 can be secured to the corners of the enclosure 10 to further protect them.

Referring now to FIGS. 2A–2H, the enclosure 210 having a body 217 formed of a top wall 211, side walls 212, a bottom wall 214, a speaker chamber back wall 229, and a head shelf 244, is similar to the enclosure 10. However the enclosure 210 has a head (amplifier compartment) 240 rather than a rack compartment. The head compartment 240 is disposed above a speaker chamber 220 which is like the speaker chamber 20. A tray 250 (like the tray 50) is secured to the body 217.

The head compartment 240 is open at the front and rear and air can flow through the openings and through one opening and out the other. A hinged rear door 233 and a hinged front lid 227 function similarly to the door 33 and the lid 27 of the enclosure 10. To facilitate and enhance air circulation, a fan 241 is mounted on a fan mount 242 which is mounted to the inside of the top of the body 217. The fan can be battery powered or use available electric current via an extension cord and it can rotate in either direction to either blow or pull air.

An amplifier or head (not shown) is supported by a head shelf 44 which extends across the head compartment 40. Further protection of the head is provided by a foam liner 43 on the interior walls of the head compartment 240.

The enclosure 210 has a pedestal insertion system like the pedestal-24-recess-52 system in the enclosure 10. The pedestal 224 is received in and held by the recess 252 of the tray 250 to releasably secure the body 217 on the tray 250 and inhibit the separation of the tray from the body.

Referring now to FIGS. 3A–3H, the audio equipment enclosure 310 is similar to the enclosures 10 and 201, but it has both a rack compartment 330 for audio effects devices and a head compartment 340 for amplification devices. There is also a speaker chamber 320 for two speakers 321.

A rear lid 333 of the enclosure 310 is hingedly connected to the speaker chamber back wall 329 by a hinge 334. The rear lid 333 is of sufficient length that it can close off both the opening in the rear of the rack compartment 330 and the opening in the rear of the head compartment 340. Similarly the front lid 327 extends sufficiently so that it can close off the front opening of the rack compartment 330 and the front opening of the head compartment 340, and so that it can cover and protect the speakers 321 and the front of the speaker chamber 320. An opening or openings such as the rack shelf holes 339 can be provided to facilitate air flow around and about audio effects devices (not shown) in the rack compartment 330.

Referring now to FIGS. 4A–4H, the enclosure 410 is similar to the enclosure 10, but it has four speakers 421 as compared to the two speakers 21 of the enclosure 10. In other respects the enclosure 410 is like the enclosure 10; for example the tray 450 functions as the tray 50, the rear door 433 functions as the door 33, and the front lid 427 functions as the lid 27.

Referring now to FIGS. 5A–5H, the enclosure 510 is similar to the enclosure 210; but the enclosure 510 has four speakers 521 as compared to the two speakers 221 of the enclosure 210. FIGS. 5B, 5E, 5F and 5H illustrate the use of a microphone installed in the enclosure. A microphone 559 is secured to the side wall 512 of the enclosure and positioned in front of one of the speakers 521. A microphone cord 560 is connected to the microphone 559 and runs to the microphone plug installed in a rear wall 529. By connecting to the microphone plug 560, the microphone output can be transferred to a remote location as desired, such as to a main mixing console board or to a remote recording location. Of course it is within the scope of this invention to so use and position one or more microphones near each speaker of each embodiment of the invention.

Referring now to FIGS. 6A–6C, the enclosure 610 has a body 617 which includes a top wall 611, side walls 612, a bottom wall 614 and a rack shelf 636. The enclosure 610 includes a rack compartment 630 and a head compartment 640. A rear lid 633 hingedly connected to the bottom wall 614 by a hinge 634 is movable to close off the back of the body 617 including the rear of the rack compartment 630 and the rear of the head compartment 640. Similarly a front lid 627 hingedly connected to the bottom wall 614 is movable to close off the front of the body 617 including the front of the rack compartment 630 and the front of the head compartment 640. Rack shelf holes 639 facilitate air flow.

The enclosure 610 has a pedestal 624 which extends into and is held by a recess 652 in a tray 650 releasably securing the tray 650 to the body 617. Also tray locks 655 on the tray 650 engage tray lock receivers 618 on the body 617 to releasably secure the tray 650 to the body 617. Both the pedestal-recess combination and the tray-lock-tray-lock-receiver combination serve to stabilize the body-tray combination and to insure correct positioning of the body with respect to the tray. A recess 654 in the top of the enclosure 610 is fashioned to receive an extending or projecting member of another enclosure stacked on top of the enclosure 610. An amplifier (head) can be set on the head shelf 644 without permanently or semi-permanently attaching it to the shelf on to the side walls 612. Audio effects devices can be placed on the rack shelf 636 without permanently or semi-permanently attaching or connecting them either to the rack shelf 636 or to the rack vertical members 631 via holes 637.

In conclusion, therefore, it is seen that the present invention and the embodiments disclosed herein are well adapted to carry out the objectives and obtain the ends set forth at the outset as well as others inherent therein. Certain changes can be made in the methods and apparatuses disclosed without departing from the spirit and the scope of this invention. While there have been described various embodiments of the present invention, the methods and apparatuses described are not intended to be understood as limiting the scope of the invention. It is realized that changes therein are possible and it is further intended that each element recited in any of the following claims, each combination of elements, and each method step or combination of steps is to be understood as referring to all equivalent elements, equivalent steps, and equivalent combinations, for accomplishing substantially the same results in substantially the same or equivalent manner. It is intended that the claims cover the invention broadly in whatever form its principles may be utilized.

What I claim is:

1. An audio equipment enclosure comprising a body, a compartment means in the body for enclosing audio equipment the compartment means including a shelf connected to the body member and supporting enclosed audio equipment, the compartment means having a speaker compartment for enclosing and supporting one or more audio speakers, a tray releasably secured to the body, the tray having rotatable wheels mounted on its bottom for facilitating the movement of the enclosure, the body having a body bottom and a pedestal protruding from the body bottom and extending across the body bottom, and the tray having a tray recess fashioned to receive and hold the pedestal means of the body, the pedestal means and tray recess for firmly positioning the enclosure on the tray.

2. The enclosure of claim 1 wherein the compartment means includes a rack compartment int he body for removably enclosing and supporting one or more audio effects devices while said audio effects devices are in use.

3. The enclosure of claim 1 wherein the compartment means includes a head compartment for removably enclosing and supporting audio amplification means while said audio amplification means are in use.

4. The enclosure of claim 1 wherein the compartment means has an open front and an open rear and a closure means comprising a front lid hingedly connected to the body for closing of the open front of the compartment means, and a rear door hingedly connected to the body for closing off the open rear of the compartment means.

5. The enclosure of claim 1 wherein the pedestal means has an irregularly shaped portion and the tray recess is fashioned to correspond to the irregularly shaped portion.

6. The enclosure of claim 1 wherein

The body having a top and a recess in the top for receiving a pedestal means extending from another enclosure.

7. An audio equipment enclosure comprising the body having a top and a recess in the top for receiving a pedestal means extending from another enclosure, a compartment means in the body for enclosing audio equipment, the compartment means including a shelf connected to the body member and supporting enclosed audio equipment, the compartment means having a speaker compartment for enclosing and supporting one or more audio speakers, a tray releasably secured to the body, the tray having rotatable wheels mounted on its bottom for facilitating the movement of the enclosure, the body having a body bottom and a pedestal protruding from the body bottom and extending across the body bottom, the tray having a tray recess fashioned to receive and hold the pedestal means of the body, the pedestal means and tray recess for firmly positioning the enclosure on the tray, a rack compartment in the body for removably enclosing and supporting one or more audio effects devices while said audio effects devices are in use, a head compartment for removably enclosing and supporting audio amplification mean while said audio amplification means are in use, the compartment means having an open front and an open rear and a closure means comprising a front lid hingedly connected to the body for closing of the open front of the compartment means, a rear door hingedly connected to the body for closing of the open rear of the compartment means.

* * * * *